US008528307B2

(12) United States Patent
Thierig et al.

(10) Patent No.: US 8,528,307 B2
(45) Date of Patent: Sep. 10, 2013

(54) METHOD OF, AND APPARATUS FOR, FILLING AND CLOSING TOBACCO BAGS

(75) Inventors: Jörg Thierig, Aystetten (DE); Burkard Roesler, Blender (DE); Thomas Häfker, Langwedel (DE); Henry Buse, Visselhövede (DE); Konrad Popp, Augsburg (DE); Holger Witzmann, Friedrichshafen (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 742 days.

(21) Appl. No.: 12/739,971

(22) PCT Filed: Nov. 3, 2008

(86) PCT No.: PCT/EP2008/009245

§ 371 (c)(1),
(2), (4) Date: Apr. 27, 2010

(87) PCT Pub. No.: WO2009/059729

PCT Pub. Date: May 14, 2009

(65) Prior Publication Data

US 2010/0242972 A1 Sep. 30, 2010

(30) Foreign Application Priority Data

Nov. 9, 2007 (DE) ..... 10 2007 053 854

(51) Int. Cl.
*B65B 1/04* (2006.01)
*A24B 1/10* (2006.01)

(52) U.S. Cl.
USPC ..... 53/469; 53/136.3; 53/482; 53/570

(58) Field of Classification Search
USPC ..... 53/469, 482, 136.3, 136.5, 570, 266.1, 53/284.7; 32/112
See application file for complete search history.

(56) References Cited

U.S. PATENT DOCUMENTS

| | | | | | |
|---|---|---|---|---|---|
| 3,394,870 | A | * | 7/1968 | Curtis | 206/94 |
| 4,680,024 | A | * | 7/1987 | Focke et al. | 493/197 |
| 4,696,146 | A | | 9/1987 | Esch et al. | |
| 4,723,394 | A | * | 2/1988 | Focke et al. | 53/562 |
| 5,174,088 | A | * | 12/1992 | Focke et al. | 53/431 |
| 5,425,215 | A | * | 6/1995 | Lewis et al. | 53/170 |
| 5,465,554 | A | * | 11/1995 | Lewis et al. | 53/438 |
| 5,528,883 | A | * | 6/1996 | Jamison | 53/562 |

(Continued)

FOREIGN PATENT DOCUMENTS

| | | |
|---|---|---|
| DE | 2453201 | 5/1976 |
| DE | 3222102 | 12/1983 |

(Continued)

*Primary Examiner* — Hemant M Desai
(74) *Attorney, Agent, or Firm* — Laurence P. Colton; Smith Risley Tempel Santos LLC

(57) ABSTRACT

A method and apparatus for filling, closing, folding and transporting away tobacco bags (10) or pouches, using a turret (24) that rotates about a horizontal axis and has preferably six mounts (28), each for one bag (10), arranged along the circumference in the region of planar wall portions (29). The bags are conveyed through a plurality of processing stations, in particular through a filling station, suction-extraction station, closing station and wrapping station, by the turret (24) with cyclic rotary movement. A plurality of sub-turrets, each with corresponding mounts (28), can be arranged one beside the other in the axial direction.

25 Claims, 10 Drawing Sheets

(56) References Cited

U.S. PATENT DOCUMENTS

| | | | | |
|---|---|---|---|---|
| 6,044,624 | A * | 4/2000 | Focke et al. | 53/438 |
| 7,937,916 | B2 * | 5/2011 | Thierig et al. | 53/562 |
| 2010/0058714 | A1 * | 3/2010 | Hoppe et al. | 53/438 |

FOREIGN PATENT DOCUMENTS

| | | |
|---|---|---|
| DE | 3409263 | 9/1985 |
| DE | 3721675 | 1/1989 |
| EP | 0870683 | 10/1998 |
| EP | 0879762 | 11/1998 |
| EP | 1048230 | 2/2000 |
| EP | 0970885 | 12/2000 |
| FR | 2767306 | 2/1999 |
| WO | WO 94/23997 | 10/1994 |

* cited by examiner

Fig. 1
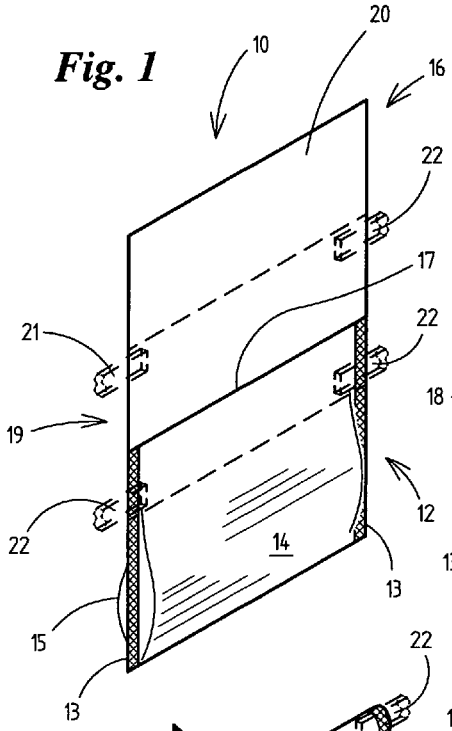
Fig. 2
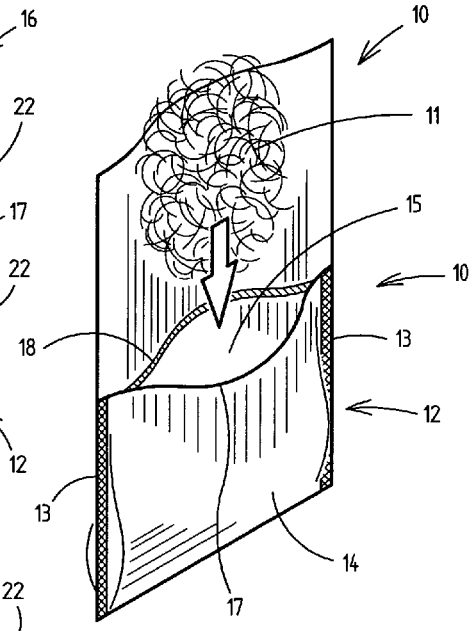
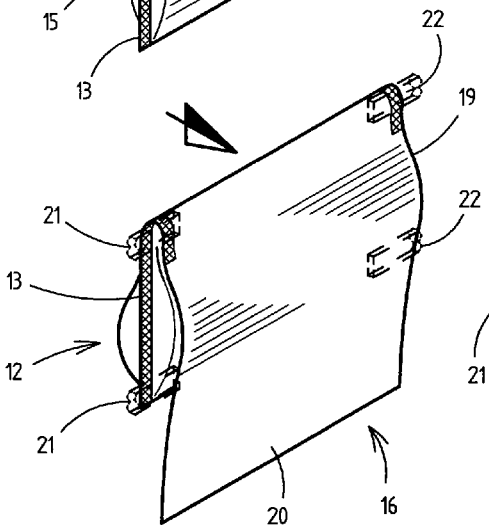
Fig. 3
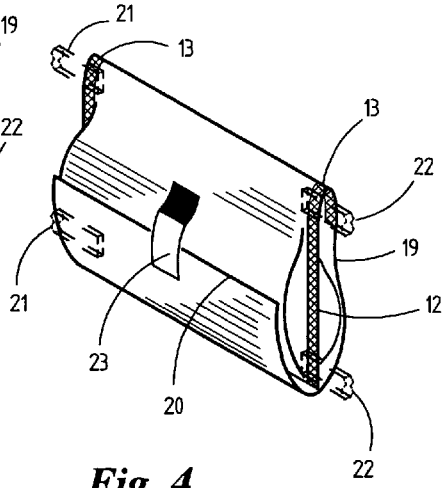
Fig. 4

*Fig. 8*
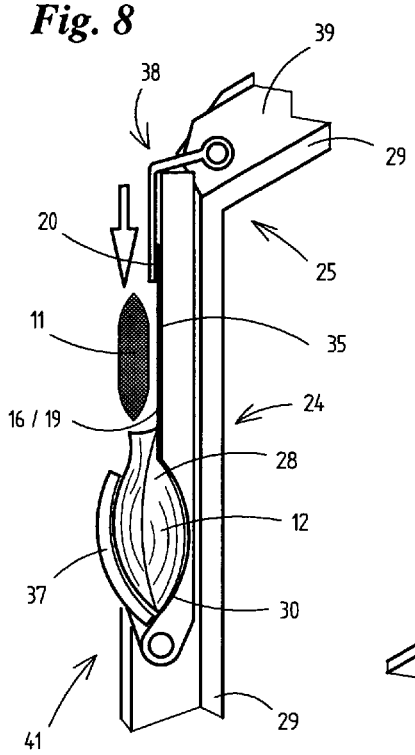
*Fig. 9*
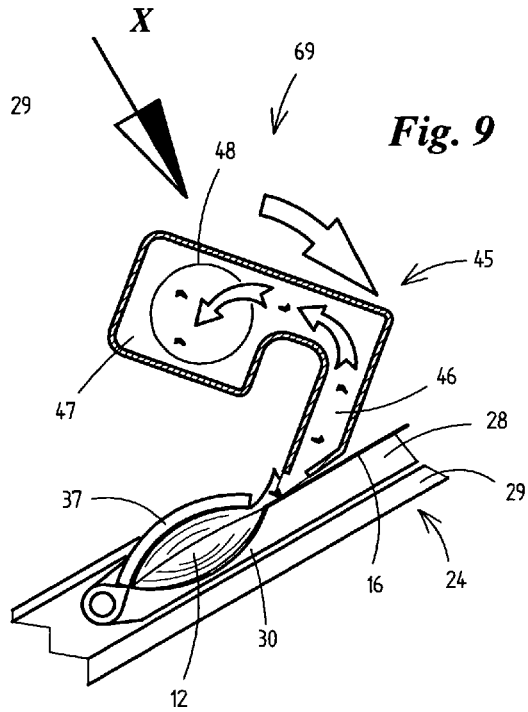
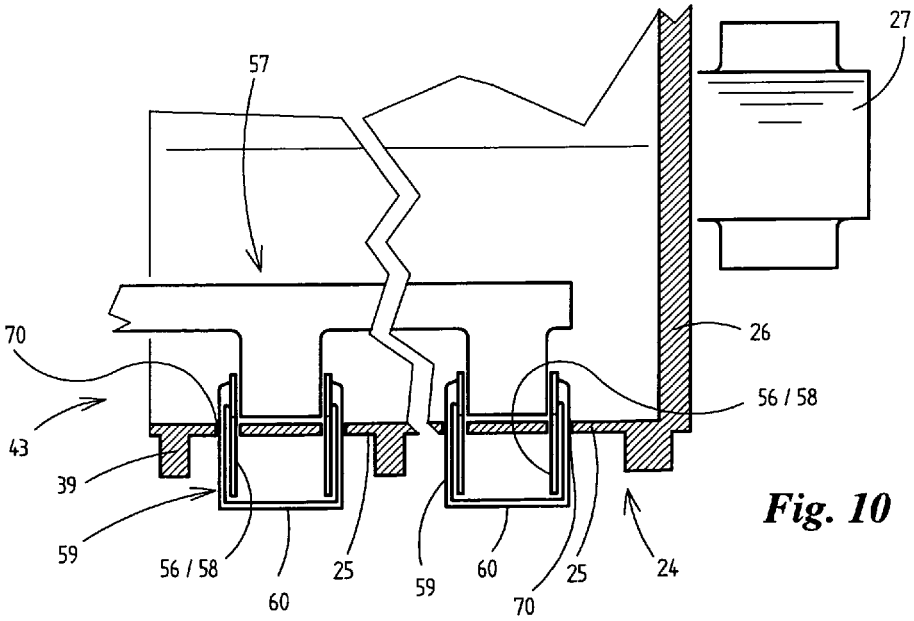
*Fig. 10*

*Fig. 12*
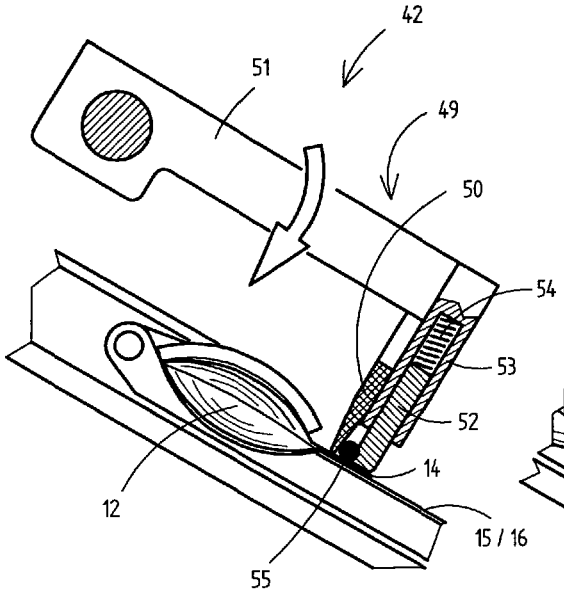
*Fig. 13*
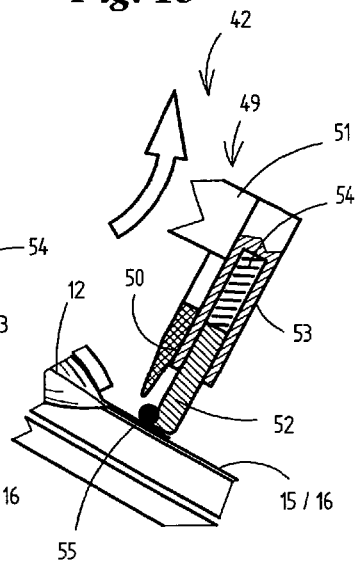
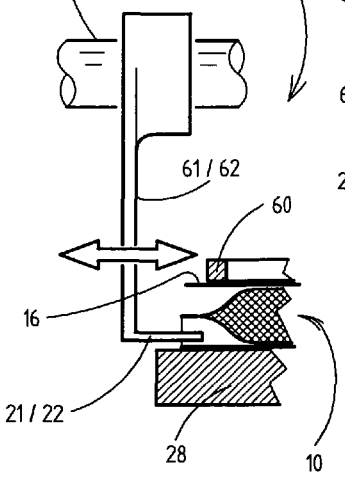
*Fig. 15*
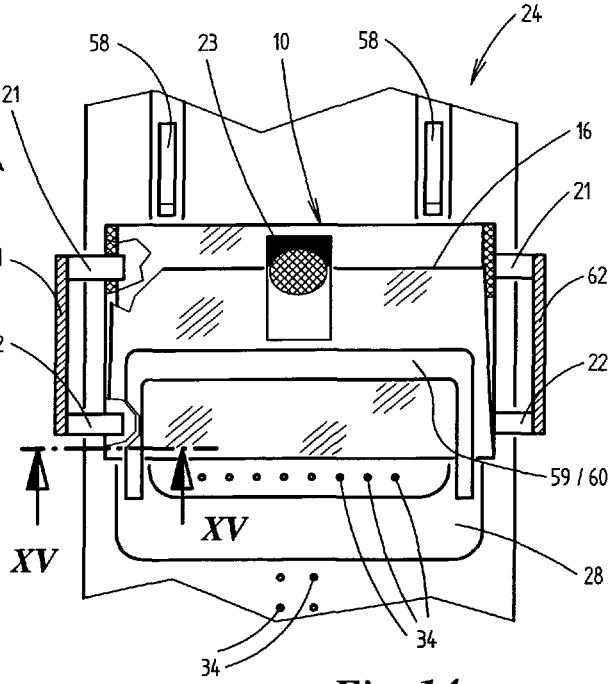
*Fig. 14*

*Fig. 16*
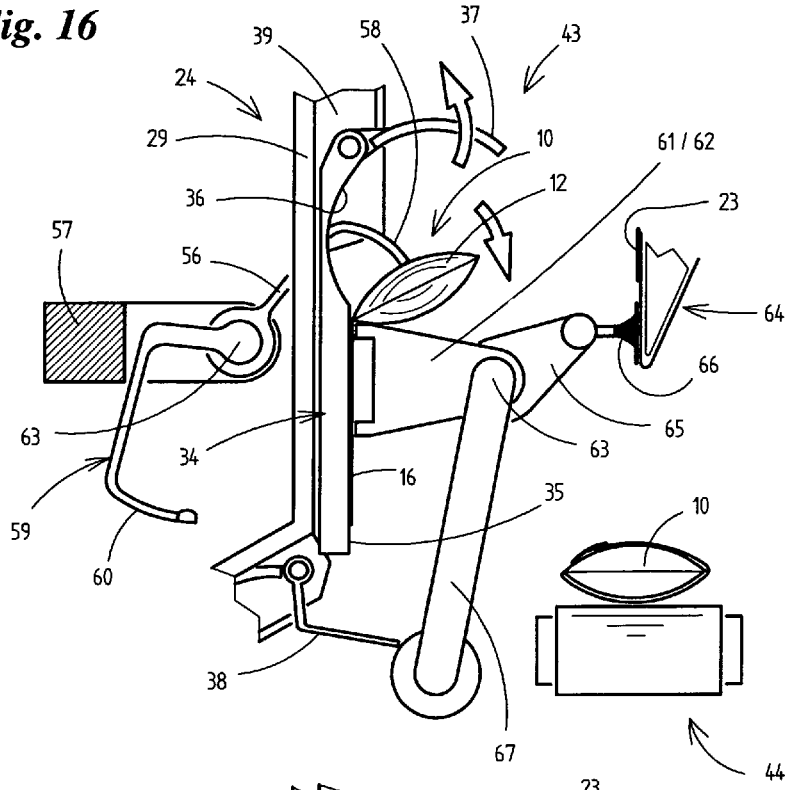
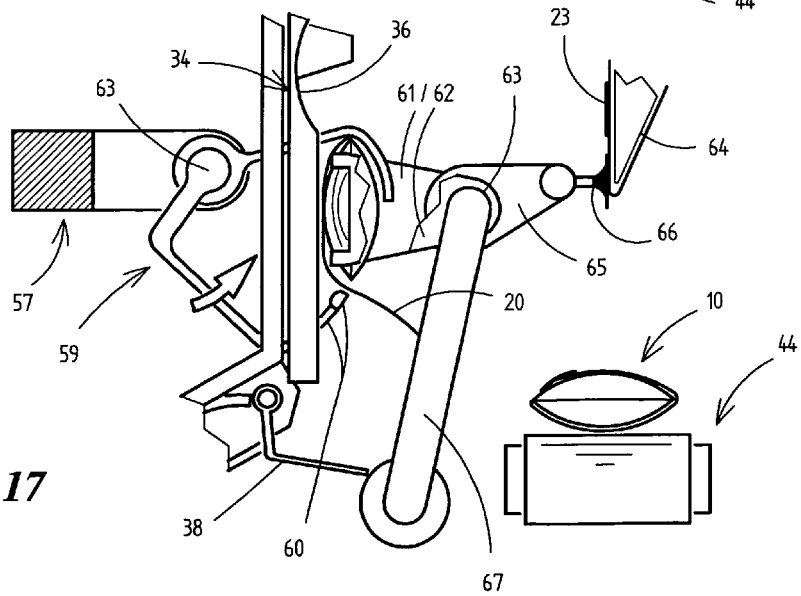
*Fig. 17*

*Fig. 18*
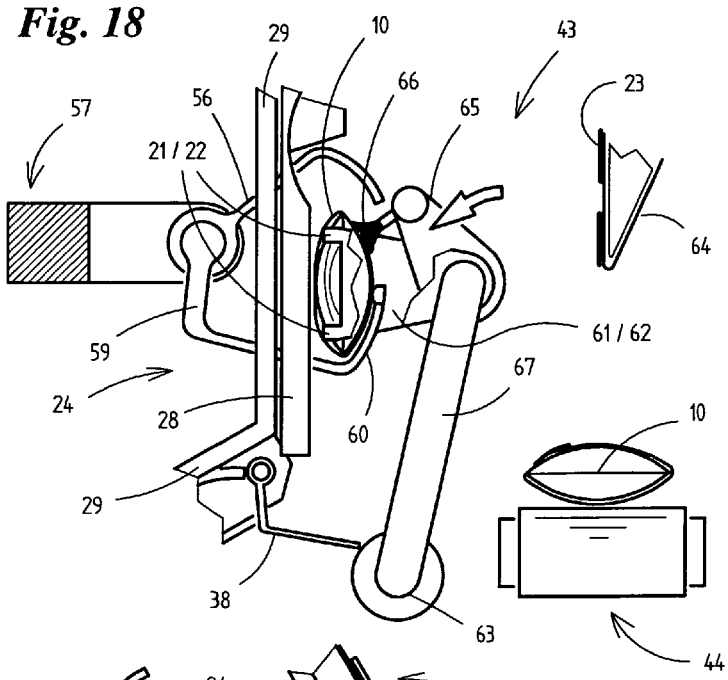
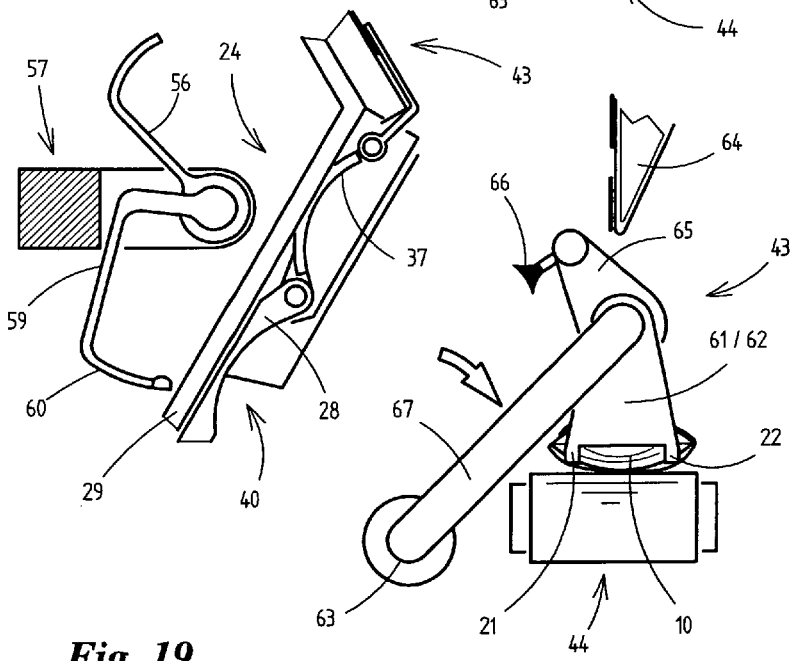
*Fig. 19*

METHOD OF, AND APPARATUS FOR, FILLING AND CLOSING TOBACCO BAGS

BACKGROUND OF THE INVENTION

1. Technical Field

The invention relates to a method of filling and closing bags made of sheet material, in particular for (cut) tobacco, having a pocket which has a closable opening and is intended for accommodating the bag contents, wherein the bag is filled in an upright position on a circulating carrier or turret and is then closed by means of closure strips in the region of the opening. The invention also relates to an apparatus for implementing the method.

2. Prior Art

In the case of a known apparatus for filling and closing tobacco bags (EP 0 870 683 B1), bags are positioned in pairs on the circumference of a turret which rotates about a vertical axis and forms a carrier for the bags. The turret forms—as in the case of a square—four retaining surfaces, located opposite one another in pairs in each case, for in each case two tobacco bags. The pockets are sealed closed in the region of the opening once a tobacco portion has been introduced.

An apparatus according to this prior art lacks output capacity. Furthermore, it is technically unavoidable that the overall length of the apparatus is relatively large.

BRIEF SUMMARY OF THE INVENTION

Accordingly, it is the object of the invention to propose measures for high-capacity production of bags, in particular tobacco bags, while the finished bags have a quality which meets the market requirements.

In order to achieve this object, the method according to the invention is a method of filling and closing bags made of sheet material or the like, in particular for (cut) tobacco, having a pocket which has a closable opening and is intended for accommodating the bag contents, wherein the bag is filled in an upright position on a circulating carrier or turret and is then closed by means of closure strips in the region of the opening, characterized by the following features: a) the prefabricated, empty bags are transported along a feed path, or by a feed conveyor, into the region of a filling and closure station, b) the bags are received by a filling and closure conveyor, in particular by a turret, and conveyed by the latter, in a plane transverse to the feed path, in particular in an upright plane, through filling, closure and possibly other processing stations, and c) the filled and closed bags are transferred from the filling and closure conveyor to a removal conveyor, which transports the bags away, in particular in a direction parallel to the feed conveyor.

A special feature of the present method may be considered that of the handling of the bags, namely in particular filling, closing and possibly wrapping, taking place in a movement plane of the bags which runs transversely to the feed and/or removal direction. Accordingly, the movement path of the bags during processing is directed along a circulatory path with a horizontal axis of rotation or circulation. This gives rise, in the first instance, to the movement paths being divided up in a space-saving manner. Furthermore, it is possible for a plurality of bags to be processed in parallel (transversely directed) planes preferably simultaneously and synchronously without this giving rise to a significant increase in the overall length of the apparatus.

As far as the apparatus is concerned, a rotary bag conveyor or turret with a horizontal axis-of-rotation element forms the core of the invention. The bag conveyor, which possibly comprises a plurality of sub-turrets arranged equiaxially one beside the other, transports the bags through a plurality of processing stations, preferably with cyclic driving. The turret, or each sub-turret, has a polygonal, in particular hexagonal, cross section, that is to say it has six planar outer surfaces or wall portions, on each of which a securing means for a bag is fitted. Arranging the turret, or the sub-turrets, in upright planes or transversely to the feed direction of the bags makes it possible, without any significant change in the machine dimensioning, for a plurality of sub-turrets to be located one beside the other in the axial direction and thus to increase the output capacity of the apparatus to a considerable extent.

The bags positioned on the turret, or on the turret surfaces, run through processing stations appropriate to the operating sequence, namely a filling station 41, optionally suction-extraction station, a closure or sealing station and a wrapping and discharging station. Predominantly fixed-location, movable processing mechanisms are arranged in the region of these stations.

BRIEF DESCRIPTION OF THE DRAWINGS

Further details of the invention relate to the specially designed processing mechanisms of the bag in the different stations. These details will be explained more specifically hereinbelow with reference to the exemplary embodiments of the invention which are illustrated in the drawings, in which:

FIG. 1 shows a perspective illustration of an unfilled, open (tobacco) bag,

FIG. 2 shows the bag according to FIG. 1 during filling,

FIG. 3 shows the bag during a (first) folding step,

FIG. 4 shows the bag according to FIGS. 1 to 3 in the closed position, FIG. 8 shows, on an enlarged scale, a detail VIII of the turret according to FIG. 6, FIG. 9 shows an illustration analogous to FIG. 8 of a cleaning and/or suction-extraction station, FIG. 10 shows the detail according to FIG. 9 as seen in the direction of arrow X in FIG. 9, FIG. 12 shows a further detail XII from FIG. 6, namely a closing station, partly in section, FIG. 13 shows part of the detail according to FIG. 12 in a different position, FIG. 14 shows a view or a section XIV-XIV from FIG. 6, namely a wrapping and discharging station, FIG. 15 shows, on an enlarged scale, a detail of the illustration according to FIG. 14 as seen along section plane XV-XV, FIG. 16 shows, on an enlarged scale, a side view of a station of the turret, namely a folding and discharging station, FIG. 17 shows the detail according to FIG. 16 with individual mechanisms in different positions, FIG. 18 shows the station according to FIGS. 16 and 17 during the operation of applying a closure strip to the bag, FIG. 19 shows the station according to FIGS. 16 to 18 during transfer of a bag to a removal conveyor.

DETAILED DESCRIPTION OF PREFERRED EMBODIMENTS

Figure 5:
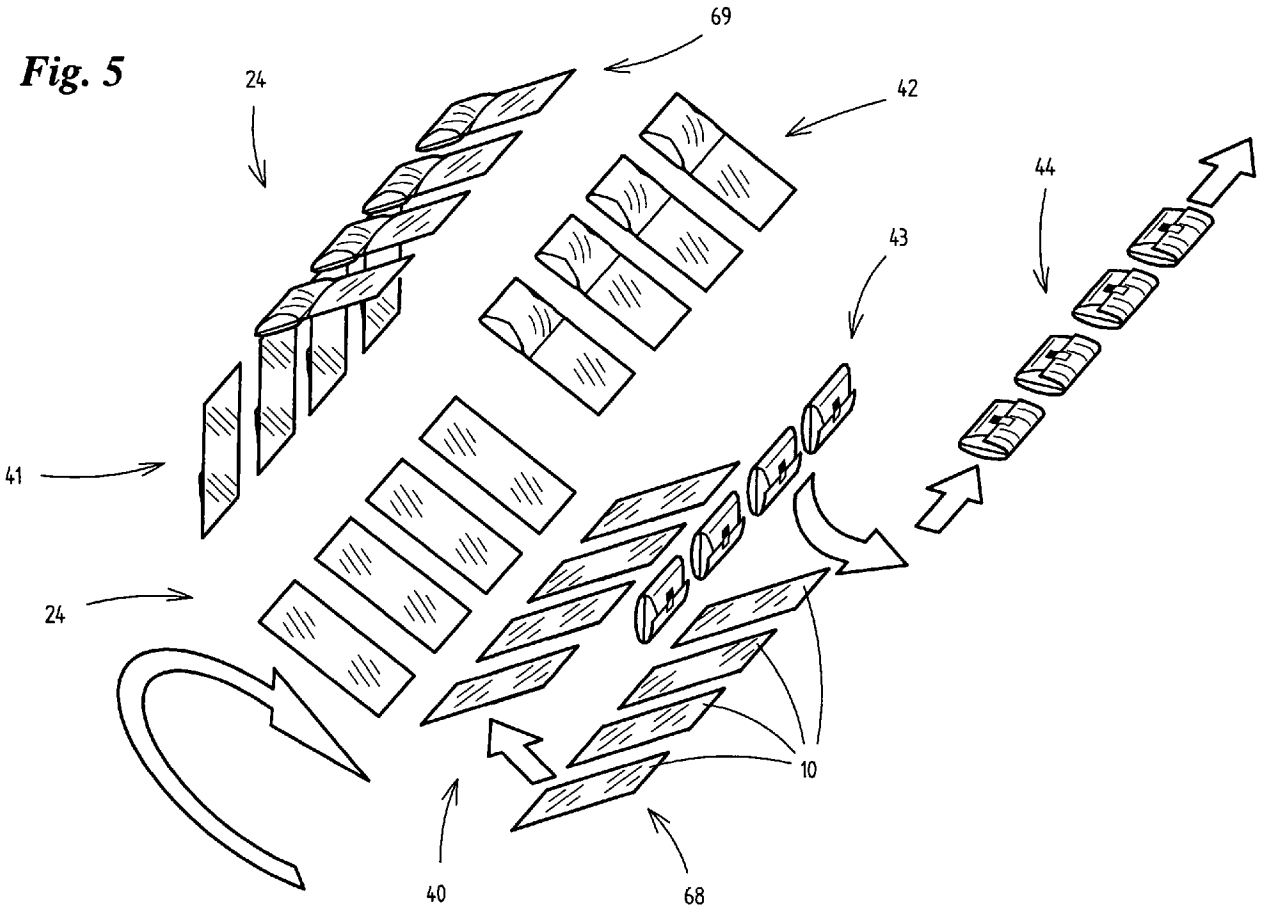
FIG. 5 shows a perspective illustration showing the movement of the bags.

The exemplary embodiments in the drawings concern the production and/or filling and the closure of bags 10 for a respective tobacco portion 11 or for other pack contents in piece, granular or fibrous form. The bag 10 consists of a possibly multi-layered sheet material or of other, thin packing material.

The bag 10 is formed from a single, strip-form blank. Two portions of the blank, which are folded over along a folding edge and connected to one another at their peripheries by seams 13, form a front wall 14 and rear wall 15 of a pocket 12. The rear wall 15 forms a continuation projecting beyond the pocket 12, namely a wrapping flap 16. The pocket 12 has an opening 17 which serves for filling the bag 10 and for removing the contents. The opening 17 can be closed in a suitable manner, in particular by a reusable closure strip 18, which is preferably designed as a peel/seal seam.

For filling and closing the bag 10, the latter is fed in a prefabricated, unclosed state to a filling and closure station. In the region of the latter, the opening 17 is freed, the tobacco portion 11 is introduced and the pocket 12 is then closed. This is followed by a folding or wrapping process, provided the bag 10, as is the case here, is designed with a wrapping flap 16. The dimensions of the bag 10 are preferably selected so as to give rise to three folding or wrapping portions, these being indicated in FIG. 1 by transversely directed, dashed lines. The (filled) pocket 12 forms a first wrapping portion or leg. This is followed by a central portion 19, which comprises part of the pocket 12 above a filling region and part of the wrapping flap 16. The central portion 19 is adjoined by a peripheral flap 20.

During completion of the bag 10, namely during folding, the procedure is such that the central portion 19 is gripped by folding or retaining mechanisms, in the present case by retaining fingers 21, 22, which grip and fix the central portion 19. Thereafter, in the first instance, the pocket 12 is folded, as a folding leg, against the central portion 19. Finally, the peripheral flap 20 is folded over against the pocket 12, in this case against the rear wall 15 of the same. In this finished position, the wrapping flap 16 or the peripheral flap 20 thereof is fixed by a standard retaining means, in this case by an adhesive-bonding strip or a tape 23. In the case of the present exemplary embodiment, this is fitted on the completed, wrapped bag 10 (FIGS. 16 to 18). As an alternative, the unfilled bags 10 fed to the filling and closing station may already be provided with a tape 23 fitted on the wrapping flap 16.

The bag 10 is retained in a vertical plane prior to, and during, the wrapping process. It is a special feature here that the pocket 12 is located above the wrapping flap 16 and, accordingly, is placed against the central portion 19 by being moved or folded downward (FIG. 3). Accordingly, the downwardly oriented peripheral flap 20 is folded upward. The retaining mechanisms or retaining fingers 21, 22 remain in the retaining position according to FIG. 4 until the bag has been completed and during transfer to a removal conveyor.

The central subassembly of the filling and closing station is a bag conveyor, which conveys the bags 10 through the necessary number of processing stations. The bag conveyor is a (drum) turret 24, a hollow body which is driven in rotation about a horizontal axis, to be precise in successive sub-steps from station to station. The turret 24 has a continuous outer wall 25, forming a carrier of the bags 10, which abut on the outside. In the exemplary embodiment according to FIG. 10, the hollow body is closed by an end wall 26 on merely one side, but is open opposite (FIG. 10). The end wall 26 serves for mounting the turret 24 on a drive shaft 27.

Figure 6:
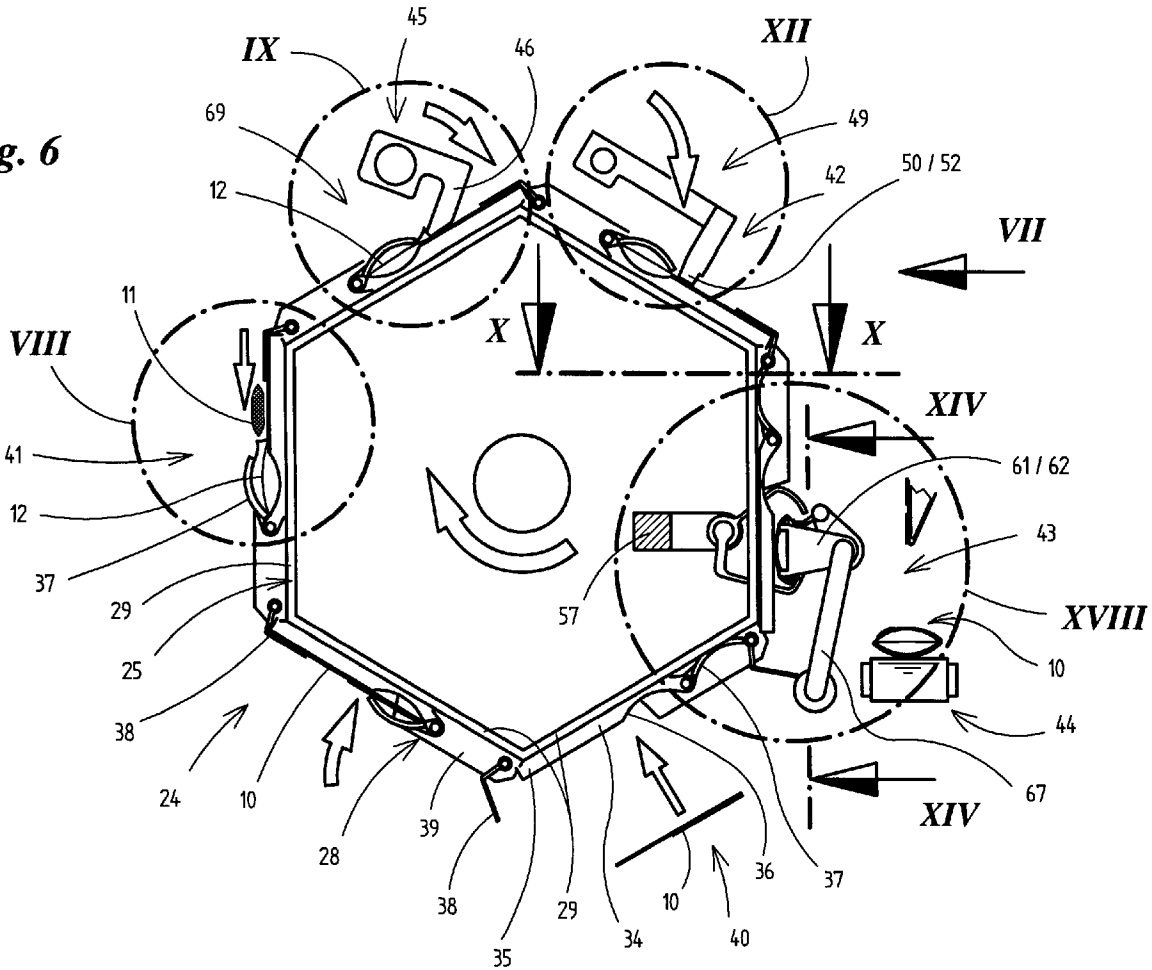
FIG. 6 shows a side view of a bag conveyor, namely a (drum) turret.

Mounts 28 for bags 10 are arranged on the outside of the turret 24, namely on the outer wall 25 thereof. For this purpose, the turret 24 is provided with a polygonal outer contour. A plurality of respectively planar wall portions 29 are connected to one another to form a uniform cross section. A particularly advantageous embodiment is that which is shown in FIG. 6, with a hexagonal turret 24 and, accordingly, six successive, planar wall portions 29 which are arranged at equal angles to one another. Each wall portion 29 has a mount, the wall portion 29 and the mount 28 fitted thereon being assigned to one bag 10 in each case.

The turret 24 is mounted such that it can be rotated about a horizontal axis. This gives rise to a closed circulatory path for the mounts 28 in a vertical plane. The turret 24 preferably comprises a plurality of sub-turrets 30, 31, 32, 33 which are located one beside the other in the axial direction. In the case of the present exemplary embodiment, the turret 24 with four sub-turrets 30, 31, 32, 33 forms a unit, namely a common hollow body. The latter is mounted on a common driveshaft 27. The sub-turrets 30, 31, 32, 33 are designed to correspond to one another and have the same dimensions. The standard configuration means that the bags 10 arranged on each sub-turret 30, 31, 32, 33 are conveyed simultaneously through the processing stations assigned to each sub-turret 30, 31, 32 33, and are processed simultaneously therein. Accordingly, this gives rise in each case to the simultaneous completion and depositing of a number of bags 10 which corresponds to the number of sub-turrets 30, 31, 32, 33. As an alternative, it is possible for the sub-turrets 30, 31, 32 33 to be designed as independent bag conveyors which either are mounted on a common driveshaft or can be driven separately. In the case of this embodiment, the sub-turrets 30, 31, 32, 33 can be exchanged individually. Overall, the capacity of the turret 24 can easily be increased by a change in the number of sub-turrets 30, 31, 32 33, without this necessitating any significant change in the machine-specific dimensioning of the apparatus.

The turret 24, or each sub-turret 30, 31, 32 33, is provided with a plurality of mounts 28 which are distributed along the circumference. An advantageous design is one in which a mount 28 is fitted on each wall portion 29. The mounts 28 are plate-like moldings with mechanisms or auxiliary means for retaining and aligning a respective bag 10. The retaining means may act mechanically and/or pneumatically.

In the case of the exemplary embodiment shown, the mount 28 is fitted eccentrically on the respective wall portion 29, that is to say it is offset in the direction of rotation of the turret 24. The plate-like mount 28 forms a planar abutment surface 35 essentially for the abutment of the planar, aligned wrapping flap 16. A trough-like shaped surface 36 is also formed for the abutment of the pocket 12.

The prefabricated, unfilled bag 10 is placed on the mount 28 and fixed by suction air and/or by clamping mechanisms. A pocket holder 37, which is connected in a pivotable manner to a free end of the plate of the mount 28, is placed on the bag 10 such that essentially the region of the pocket 12 is gripped and fixed. A further retaining mechanism grips the wrapping flap 16, namely a clamping lever 38, which is of angular design and is mounted in a pivotable manner on a carrying part 39 of the adjacent wall portion. The clamping lever 38 grips the wrapping flap 16, by way of an angular retaining leg, in the region of the peripheral flap 20. As an alternative, the clamping lever 38 can perform some other, or additional, task.

If—as an alternative to the exemplary embodiments shown—the tape 23 is fed to the filling and closing arrangement together with the unfilled bag 10, the clamping lever 38 can serve as a covering mechanism for the exposed region of the adhesive-bonding side of the tape 23. The leg of the clamping lever 38 covers over the adhesive-bonding part of the tape 23, preferably at a small distance from the adhesive-bonding surface.

An important retaining means for the bag 10 in the region of the mount 28 is constituted by suction bores 34 both in the region of the abutment surface 35 for the wrapping flap 16 and in the region of the shaped surface 36 for the pocket 12. It is also the case when the wrapping flap 16 is straightened out that the bag 10 is fixed largely over the entire surface area by the suction bores 34. The latter can be switched off during the wrapping operation.

The relative positions of the turret 24 and/or the rotary steps are selected such that, during the respective standstill, two mutually opposite wall portions 29 are directed vertically and in each case two further wall portions 29 in the bottom region and in the top region are directed obliquely in the form of a roof, in a position in which they are symmetrical to an imaginary vertical center plane. The stations of the turret 24 are distributed such that, in a charging station 40 at the bottom, the bags 10 or corresponding blanks are placed on the obliquely downwardly directed mount 28. The bag 10 is fixed by virtue of the pocket holder 37 and the clamping lever 38 being pivoted until they butt against the bag 10 and by virtue of negative pressure at the suction bores 34.

The next conveying cycle brings the bag 10 to an idling station, in which there are no operating steps carried out. Thereafter, the mount 28, together with the bag 10, passes into a filling station 41. The pocket 12 is then located in the bottom part of the mount 28, with the opening 17 oriented upward. The tobacco portion 11 is then introduced into the (upright) bag 10 from above, by suitable filling mechanisms, via the freed opening 17.

In the next station, in which the bag 10 is in an oblique position, in the case of the present exemplary embodiment (tobacco) particles are removed from the region of the opening 17 in an appropriately equipped suction-extraction station 69.

Following a further switching step, the mount 28 passes into a position in which the bag 10 assumes a downwardly inclined oblique position. In this station, a closing station 42, the opening 17 is closed, to be precise by virtue of a closure seam being applied by thermal sealing. An advantageous alternative provides for the closing station 42 to be shifted into the region of the suction-extraction station 69 and for the latter to be dispensed with out replacement. In this variant, the bag 10 is located in an upwardly inclined oblique position, and therefore it is not possible for any contents to escape from the (still open) pocket 12.

Thereafter, corresponding rotation of the turret 24 conveys the mount 28 into an upright position again. In this region, a wrapping station 43, at least the wrapping flap 16 is moved into the correct position. In the present case, furthermore, the tape 23 is applied and, in the region of this station 43, the finished bag 10 is transferred to a removal conveyor 44.

The operating stations of the turret 24 are fitted with task-appropriate fixed-location subassemblies. In a suction-extraction station 69, a suction-extraction subassembly 45 enters, by way of a tapering suction connector 46, into the opening 17 of the pocket 12 and takes effect above the filling region for the suction extraction of particles. The opening 17 here is retained in the closed position, by way of the curved pocket holder 37, to the extent where the suction extraction of tobacco from the interior of the pocket 12 is avoided. The particles extracted by suction in the closing region of the opening 17 pass into a collecting space 47 and are led away through a transversely directed, axis-parallel suction tube 48. In the case of a plurality of sub-turrets 30, 31, 32 33 arranged one beside the other, a common suction tube 48 is provided for a plurality of adjacent collecting spaces 47 and suction connectors 46.

Figure 11:
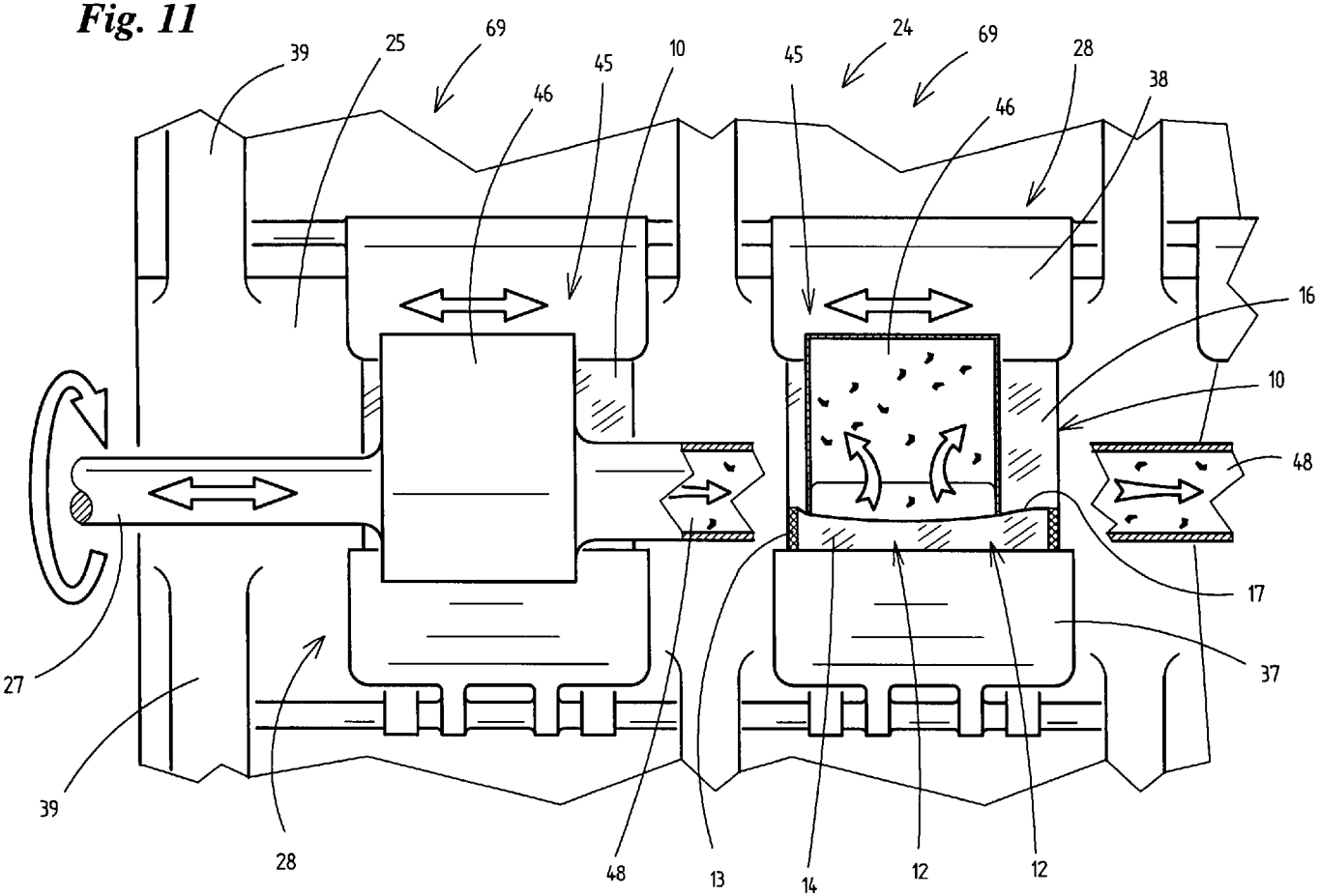
FIG. 11 shows a further-enlarged view of mechanisms according to FIGS. 9 and 10, partly in section.

As can be seen from FIG. 11, the suction connector 46 entering into the opening 17 is narrower than the bag 10 or the opening 17. Furthermore, the suction connector 46 can be moved back and forth in the axial direction, that is to say in the direction of the longitudinal extent of the opening 17. On the one hand, this facilitates the introduction of the suction connector into the opening 17. On the other hand, it is ensured that the closing region of the opening 17 is completely freed of particles and other residues.

Furthermore, the closing station 42 is designed in a particular manner. A free peripheral region of the front wall 14 of the pocket 12 is connected to the rear wall 15 here by thermal sealing, or at any rate by the transmission of heat and pressure. A sealing mechanism 49 is provided for this purpose, and this sealing mechanism, while the turret 24 is at a standstill, is pressed onto the bag 10 in the region of the opening 17. A heated sealing bar 50, which in the present case is wedge-shaped, is pressed, by way of a comparatively narrow sealing edge, against the sheets which are to be connected, and this therefore produces a sealing seam, in particular a peel/seal seam. The sealing mechanism 49 can be moved transversely, namely raised and lowered, in relation to the bag 10, in the present case by virtue of being arranged on a pivoting lever 51. When the sealing bar 50 is lifted off from the sheets, a holding-down means 52 takes effect, that is to say a cross-piece-like retaining mechanism which butts against the sheets in a free region, which is offset in relation to the sealing seam. This retaining mechanism is mounted on the sealing mechanism 49 parallel to the sealing bar 50, to be precise in a depression 53 of a holder, and it is subjected to the loading of a spring 54. When the sealing bar 50 is lifted off, the holding-down means 52, in the first instance, remains in abutment against the sealed sheets and thus prevents the same from lifting off with the sealing bar 50. As the lifting-off movement continues, the holding-down means 52 also comes away from the bag 10. An insulating delimiting means, namely a strip 55 made of rubber or plastics material, in particular TEFLON®, is applied between the sealing bar 50 and holding-down means 52. The strip 55 is applied to the holding-down means 52, namely to the bottom peripheral region thereof, and is lifted off, and moved into position, therewith. If the suction-extraction station 69 is dispensed with, the closing station 42 may be arranged in the region of the same, that is to say on a wall portion 29 which is directed upward, as seen in the direction of rotation.

In the case of the present exemplary embodiment, the wrapping station 43 is configured as a multifunctional station. The bags 10 are positioned such that the pocket 12 is positioned in the top region and the wrapping flap 16 extends beneath the pocket 12.

In the station 43, a first folding or wrapping step is carried out on the bag 10. The fixing of the top bag part, namely of the pocket 12, is released. For this purpose, the pocket holder 37 is pivoted away. Furthermore, the air supply to the suction bores 34 in the region of the shaped surface 36 is stopped. It is thus possible for the pocket 12, in a first wrapping step, to be pivoted downward into the position according to FIG. 17, namely into abutment against the central portion 19 of the wrapping flap 16. This operation of folding over the pocket 12 is assisted, or executed, by a folding lever 56 which is mounted at a fixed location, but in a pivotable manner, on a holder 57. An end region of the pivot lever 56 is designed as a bent finger 58 which is moved, by way of a free end, against the bag 10 or the pocket 12 and folds the latter over downward. In the end position (FIG. 17), the finger 58 encloses part of the pocket 12 and fixes the folding and wrapping step.

The downwardly oriented region of the wrapping flap 16, namely the peripheral flap 20, is then gripped and folded, by upward movements, against the outwardly directed free side of the bag 10 or of the pocket 12 (FIGS. 17 and 18). For this purpose, use is made of a flap folder 59 which is mounted likewise at a fixed location, but in a movable manner, in the region of the station 43, in the present case equiaxially with, or in the same pivot bearing as, the folding lever 56. The angular or U-shaped flap folder 56 grips the free part of the wrapping flap 16 by way of an angled leg 60. Upward movement of the flap folder 59 causes the peripheral flap 20 to be moved upward against the far side of the curved pocket 12. In the end position (FIG. 18), the correspondingly shaped leg 60 fixes the peripheral flap 20 in precise abutment against the pocket 12.

The holder 57 for the pivot lever 56, on the one hand, and the flap folder 59, on the other hand, is arranged at a fixed location within the turret 24 (which is open at one end). The mechanisms 56, 59 pass through specifically positioned apertures or openings in the outer wall 25 of the turret 24 and through corresponding openings and apertures in the region of the mount 28. It is also possible for other processing mechanisms to be arranged, if necessary, at a fixed location within the turret 24.

Prior to the flap folder 59 taking effect, the retaining means for the wrapping flap 16, namely the clamping lever 38 and suction bores 34 in the region of the abutment surface 35, are released. The holder 57 with the folding mechanisms for the bag 10 in the station 43 is illustrated in FIG. 10—without any further details. The holder 57, which is illustrated in a simplified state, is designed as a hollow body for accommodating gear-mechanism parts and drive means for the folding or wrapping mechanisms, namely for the fingers 58, on the one hand, and the flap folders 59, on the other hand, wherein a plurality of sub-turrets 30, 31, 32 33, which are connected to form a unit, have a common holder 57 for the folding or wrapping mechanisms and this holder 57 runs in an axis-parallel manner within the turret 24. Furthermore, the wall portions 29 and the mount 28 are provided with slot-like apertures which allow the folding and retaining mechanisms to pass through in the region of this station.

The auxiliary mechanisms described in conjunction with FIGS. 1, 3 and 4, namely the retaining fingers 21, 22, also take effect in the wrapping station 43. These retaining fingers are fitted on a common carrier, in the present case on two lateral carrying lugs 61, 62. These are mounted at a distance apart from one another on an axial carrying element 63. In the operating position, the carrying lugs 61, 62 are directed transversely to the mount 28. The retaining fingers 21, 22, in turn, are arranged transversely, namely in a hook-like manner, to the carrying lugs 61, 62 (FIG. 14). The carrying lugs 61, 62 are thus located outside the region of the bags 10, whereas the transversely directed carrying fingers 21, 22 are in contact with the free side of the bag 10, namely of the wrapping flap 16 for defining the central portion 19 (FIG. 16). The retaining fingers 21, 22 are enclosed by the wrapping flap 16 during the folding or wrapping process. With the bag 10 finished, the fingers 21, 22 engage in an inner region defined by the pocket 12, on the one hand, and the central portion 19, on the other hand. When the rest of the retaining mechanisms, namely the folding lever 56 and the flap folder 59, are released and/or drawn back, the ready wrapped bag is held in position by the retaining fingers 21, 22.

A further step is carried out in the station 43. The tape 23 for fixing the peripheral flap 20 on the pocket 12 is moved into position. The tapes 23 are fed by a tape conveyor 64 and held in readiness for transfer to a bag 10. For this purpose, a transfer mechanism is provided for a respective tape 23. This mechanism comprises a pivot arm 65 with a tape holder 66 which is fitted in a pivotable manner on the pivot arm and, in this case, is designed as a suction mechanism, that is to say as an elastic, cap-like element which is applied to the free side of a tape 23 in the region of the tape conveyor 64 and grips the tape 23, and removes it from the tape conveyor 64, by negative pressure. Movement of the pivot arm 65, on the one hand, and of the tape holder 66, on the other hand, causes the latter to pass into a position in which the tape 23 can be positioned appropriately on the bag 10 (transfer position according to FIG. 18). The peripheral flap 20 here is still retained by the flap folder 59.

The bag 10 is thus complete. In the region of the station 43, the bag 10 is discharged and transported away, to be precise by the removal conveyor 44, which is designed as an endless or belt conveyor. The bag 10 is lifted off from the mount 28, and deposited on the removal conveyor 44, with the aid of a transfer conveyor. This task is performed here by the retaining fingers 21, 22 in conjunction with the carrying lugs 61, 62. The latter can be moved in an axis-transverse manner, by means of pivot levers 67, out of the position in the turret 24 and can be deposited on a top strand of the removal conveyor 44. The retaining mechanisms, namely carrying lugs 61, 62 with the retaining fingers 21, 22, here can be rotated relative to the pivot lever 67, and therefore the carrying lugs 61, 62 are directed downwards when the bag 10 is deposited on the removal conveyor 44. In order for the bag to be transferred or to be released from the retaining fingers 21, 22, the latter can be moved apart from one another, to be precise by virtue of the carrying lugs 61, 62 being moved apart from one another, and therefore the retaining fingers 21, 22 are freed from the position between the wrapping flap 16 and pocket 12.

Figure 7:
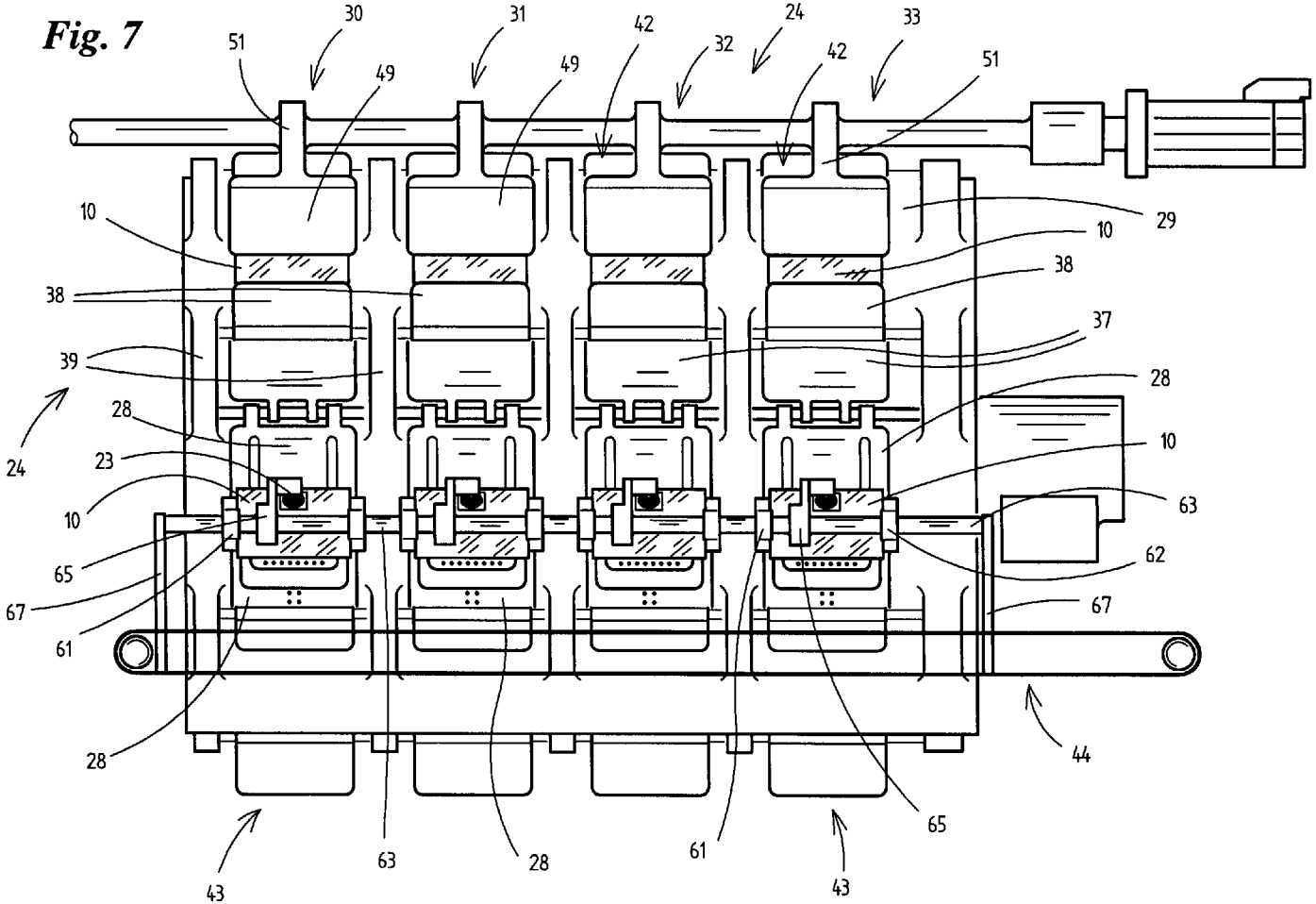
FIG. 7 shows a side view of the turret according to FIG. 6 as seen in the direction of arrow VII in FIG. 6.

The carrying lugs 61, 62 are mounted in a rotatable and axially displaceable manner on the axis-parallel axial carrying element 63. As is shown in FIG. 7, in the case of a turret 24 made of a plurality of sub-turrets 30, 31, 32, 33, a common axial carrying element 63 is provided for the carrying lugs 61, 62 assigned to each bag 10 and/or each station 43. Accordingly, the aforementioned mechanisms are actuated synchronously and simultaneously. Pivot levers 67 are arranged at the ends of the common axial carrying element 63, and therefore a plurality of, namely four, bags 10 are simultaneously lifted off from the turret 24, and deposited on the removal conveyor 44, in the manner described and in accordance with the illustration in FIGS. 18 and 19.

The pivot arms 65 for the tape holder 66, these pivot arms being assigned to each station, are also mounted in a pivotable manner on the continuous axial carrying element 63.

Figure 20:
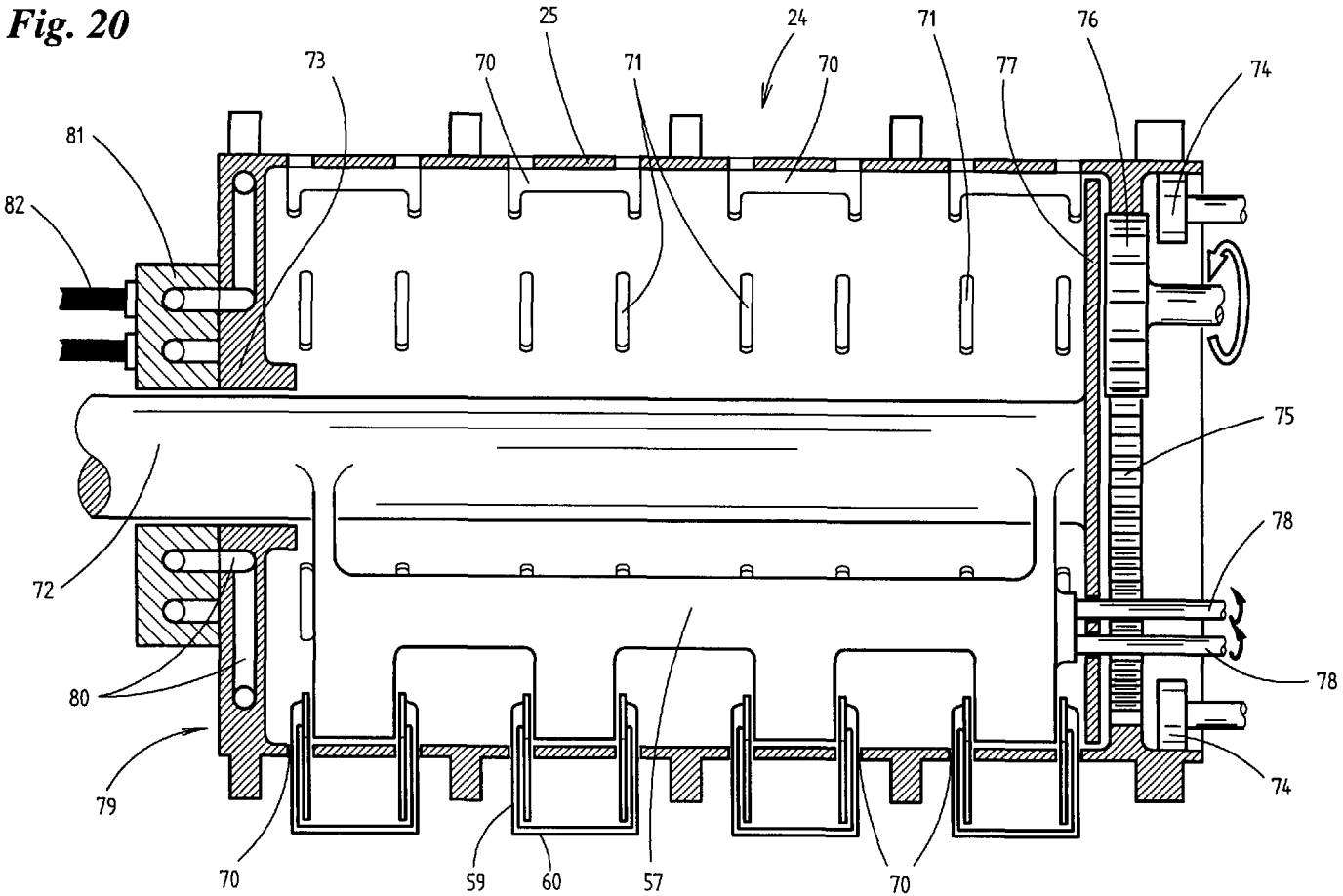
FIG. 20 shows, in longitudinal section, another exemplary embodiment of the turret.

The design and relative positioning of the turret 24 and the resulting conveying direction of the bags 10 allow a particular material flow for the apparatus as a whole (FIG. 5). The prefabricated, unfilled bags 10 are supplied on a feed conveyor 68, to be precise in groupwise fashion with relative positioning corresponding to the number of mounts 28 acting one beside the other, and to the relative positioning of these mounts. Accordingly, in the case of the present exemplary embodiment, in the region of the feed conveyor 68 four bags 10 located one beside the other are made available in the region of the charging station 40, to be precise in an obliquely positioned manner and with distances between them corresponding to the distances between the mounts 28. The bags 10 are then simultaneously placed against the mounts 28 together by an obliquely upwardly directed movement. By virtue of the rotary movement of the turret 24, or of the sub-turrets 30, 31, 32, 33, the bags are transported in a circulatory manner in a vertical plane, that is to say transversely to the direction of the feed conveyor 68. The movement path of the bags up to completion of the latter corresponds more or less to an entire revolution of the turret 40. The removal conveyor 44 is offset heightwise in relation to the feed conveyor 68, and therefore the bags 10, following completion, are discharged before the relevant mounts 28 pass into the charging station 40 again. The removal conveyor 44 is directed parallel to the feed conveyor 68, in an offset state in relation to the same and preferably in continuation of the conveying direction (FIG. 5). One special feature is the arrangement of processing, in particular folding, mechanisms in the region of the turret 24. The latter is open on one side or at one end, and therefore fixed-location mechanisms can be positioned in the interior of the turret 24. The turret 24, or the outer wall 25 thereof, is provided with apertures or openings through which the tools arranged in the interior of the turret 24 can pass in order to be able to take effect on the outside of the turret 24 in the region of the mounts 28. Apertures 70 are thus provided in the lateral surface of the turret for the through-passage of the flap folders in the region of the wrapping station 43. The flap folders 59 are designed in bracket form. The apertures 70 are shaped correspondingly (FIG. 20). Slot-like openings 71 are also provided, to be precise in each case two parallel openings 71 for the through-passage of the fingers 58 for folding (over) the pocket 12, likewise in the wrapping station 43. The aforementioned mechanisms 56, 59 are arranged in a pivotable manner on a common carrier or holder 57, which extends as a fixed mechanism in the longitudinal direction of the turret 24.

The turret 24 may also advantageously be designed in the manner shown in FIG. 20. The likewise polygonal turret 24 is mounted on a fixed axis-of-rotation element 72. The drum or the turret 24 is mounted in a rotatable manner on the axis-of-rotation element 72 or—in the case of the example according to FIG. 20—at one end on the axis-of-rotation element 72, by way of a rotary bearing 73, and on stationary supporting rollers 74 at the opposite end. The turret 24 is open at both ends. Drive power is transmitted to the turret 24 via a toothed gear mechanism. For this purpose, an inner toothed ring 75 is connected to the turret 24 in an end region of the turret 24—in this case at the end located opposite to the rotary bearing 73. The drive power is transmitted via a drive pinion 76, which in this case is arranged eccentrically and engages with the toothed ring 75. The turret 24 is provided, in the region of the drive, with a covering, namely a covering plate 77 which is arranged at the free end of the axis-of-rotation element 72. Mechanisms can pass through the covering plate 77.

It is also the case here that actuating mechanisms are fitted in the interior of the turret 24. The carrier or holder 57 for the mechanisms 56 and 59 is mounted in the interior of the turret 24 with the axis-of-rotation element 72 in a relative position corresponding to the relevant operating station. The mechanisms are passed through the apertures 70 and/or openings 71. The mechanisms 56, 59 are driven via driveshafts 78 which are mounted at a fixed location and enter into the turret 24 in the region of the drive side of the latter, to be precise through the covering plate 77.

On the opposite side, namely in the region where the turret 24 is supported on the axis-of-rotation element 72, the turret 24 is provided with an end wall 79. The latter is supported on the axis-of-rotation element by way of the rotary bearing 73. The end wall 79 is provided with a system of pneumatic lines, namely with suction bores 80. These are connected via further suction lines or channels to the wall of the turret 24, and/or to the mounts 28 for the bags 10, for supplying the suction bores 34. The suction bores 80 of the end wall 79 are connected via a fixed, annular vacuum disk 81, by way of conventional connection channels and connection lines 82, to a negative-pressure source.

LIST OF DESIGNATIONS

10 Bag
11 Tobacco portion
12 Pocket
13 Seam
14 Front wall
15 Rear wall
16 Wrapping flap
17 Opening
18 Closure strip
19 Central portion
20 Peripheral flap
21 Retaining finger
22 Retaining finger
23 Tape
24 Turret
25 Outer wall
26 End wall
27 Drive shaft
28 Mount
29 Wall portion
30 Sub-turret
31 Sub-turret
32 Sub-turret
33 Sub-turret
34 Suction bore
35 Abutment surface
36 Shaped surface
37 Pocket holder
38 Clamping lever
39 Carrying part
40 Charging station
41 Filling station
42 Closing station
43 Wrapping station
44 Removal conveyor
45 Suction-extraction subassembly
46 Suction connector
47 Collecting space
48 Suction tube
49 Sealing mechanism
50 Sealing bar
51 Pivot lever
52 Holding-down means
53 Depression
54 Spring
55 Strip
56 Folding lever
57 Holder
58 Finger
59 Flap folder
60 Leg
61 Carrying lug
62 Carrying lug
63 Axial carrying element
64 Tape conveyor

65 Pivot arm
66 Tape holder
67 Pivot lever
68 Feed conveyor
69 Suction-extraction station
70 Aperture
71 Opening
72 Axis-of-rotation element
73 Rotary bearing
74 Supporting roller
75 Toothed ring
76 Drive pinion
77 Covering plate
78 Drive shaft
79 End wall
80 Suction bore
81 Vacuum disk
82 Connection line subassembly

The invention claimed is:

1. A method of filling and closing bags (10) made of sheet material, the bags (10) having a pocket (12) which has a closable opening (17) and is intended for accommodating the bag contents, with the bag (10) being filled in an upright position on a circulating carrier or turret (24) and then being closed by means of closure strips in the region of the opening (17), comprising the steps of:

a) transporting prefabricated, empty bags (10) along a feed path, or by a feed conveyor (68), into the region of a filling and closure station;

b) receiving the bags (10) by a filling and closure conveyor, namely the turret (24), and cyclically conveying the bags (10) by the turret (24) along a circulating path, formed in a vertical plane, from a charging station (40) in the bottom region of the turret (24) to a wrapping station (43) or a discharging station for the finished bags; and c) transferring the filled and closed bags (10) from the filling and closure conveyor to a removal conveyor (44), which transports the bags (10) away in a direction parallel to the feed conveyor (68), wherein the filled and closed bags (10) are completed, in an upright arrangement, by successive folding and wrapping steps, with the filled pocket (12), in a first folding or wrapping step, being placed in a downwardly directed pivoting movement, from a position above a non-folded wrapping flap (16), against the upright wrapping flap (16) or against a central portion (19) of the wrapping flap (16), and then a downwardly oriented peripheral flap (20) of the wrapping flap (16) being folded, by upwardly directed folding movements, against an exposed side of the pocket (12), namely against a rear wall (15) of the pocket (12).

2. The method as claimed in claim 1, wherein the bag (10) is fixed, at least during the folding and wrapping process, by retaining mechanisms, in the region of the central portion (19), such that the pocket (12) and the peripheral flap (20) are folded relative to the fixed central portion (19).

3. An apparatus for handling bags (10) made of sheet material, the bags (10) having a pocket (12) which has a closable opening (17) and is intended for accommodating the bag contents, comprising a circulating cyclically movable carrier or turret (24) for conveying the bags (10) one after the other through processing stations, the carrier or turret (24) having mounts (28) for one bag (10) each, wherein the carrier or turret (24) is mounted with a horizontal axis-of-rotation element such that the mounts (28) with the bags (10) are transported along a movement path running in an upright plane, and further comprising mechanisms for processing the bags (10) being arranged at a fixed location along the movement path of the bag (10), wherein the mount (28) for the bag (10) comprises a plate-like carrying element and mechanical and/or pneumatic retaining means for fixing the bag (10), including the straightened-out wrapping flap (16), on the mount (28) during the rotary movement of the turret (24) and/or during the processing in the individual stations.

4. The apparatus as claimed in claim 3, wherein the mounts (28) are fitted in the region of planar surfaces of the turret (24), the turret (24) has a polygonal cross-section and an outer wall (25) made of adjoining, planar wall portions (29), and the mounts (28) are fitted in each case in the region of a wall portion (29).

5. The apparatus as claimed in claim 3, wherein the turret (24) has a hexagonal contour with six wall portions (29), which are connected at corresponding angles in each case to adjacent wall portions (29) such that in each case two wall portions (29) located diametrically opposite one another in pairs are directed parallel to each other.

6. The apparatus as claimed in claim 3, wherein the turret (24) comprises a plurality of sub-turrets (30, 31, 32, 33) located one beside the other in the axial direction, with each sub-turret (30, 31, 32, 33) having mounts (28) for the bags (10), said mounts having the same directional and relative positioning as each other, and the sub-turrets (30, 31, 32, 33) are connected to form a structural unit.

7. The apparatus as claimed in claim 3, wherein at least one mechanical retaining mechanism (37) for the pocket (12), and/or at least one clamping lever (38), which is assigned to the wrapping flap (16) of the bag (10) and/or the peripheral flap (20), is/are arranged on each mount (28).

8. The apparatus as claimed in claim 3, wherein the mount (28) has suction bores (34) for fixing the bag (10) on the mount (28) in the region of the pocket (12) and/or of the wrapping flap (16).

9. The apparatus as claimed in claim 3, wherein the plate-like mount (28) has a trough-like depression with a shaped surface (36) adapted to the shape of the pocket (12), and has a planar abutment surface (35) for the wrapping flap (16).

10. The apparatus as claimed in claim 3, wherein the turret (24) is assigned an obliquely downwardly directed charging station (40) for accommodating the prefabricated, empty bags (10), a subsequent filling station (41), a following closing station (42) and, thereafter, a wrapping station (43) for folding the bag (10) and for discharging the bag (10) to a removal conveyor (44).

11. The apparatus as claimed in claim 10, wherein the filling station (41) is formed in the region of a respectively upright wall portion (29) of the turret (24), with the bag (10) being positioned on the mount (28) such that the pocket (12) is oriented downward and the open opening (17) is oriented upward.

12. The apparatus as claimed in claim 10, wherein the closing station (42) is formed in the region of an obliquely directed wall portion (29), and further comprising a fixed-location, movable sealing mechanism (49) with a sealing bar (50) for butting against the bag (10) that is movable in the region of a front wall (14) of the pocket (12), outside the filling region, in order to produce and/or apply a closure seam in the region of the opening (17).

13. The apparatus as claimed in claim 12, wherein the sealing mechanism (49) or the sealing bar (50) is assigned a holding-down means (52) which, when the sealing bar (50) is lifted off from the bag (10) following a sealing cycle, are lifted off from the bag (10) with a time delay, on account of loading by a spring (54) in the direction of abutment against the bag (10).

14. The apparatus as claimed in claim 10, wherein a cleaning or suction-extraction station (69) is arranged in the region of the turret (24), upstream of the closing station (42), with the suction-extraction station (69) having a suction-extraction mechanism (46) which are introduced into the opening (17) for the suction extraction of particles in the region of the opening (17), outside the region of the contents of the pocket (12).

15. The apparatus as claimed in claim 14, wherein by virtue of the dimensions of the suction connector (48), the suction connector (48) are moved transversely within the opening (17), in order to cover the opening (17) over the entire length.

16. The apparatus as claimed in claim 10, wherein a folding or wrapping station (43) is formed in the region of an upright circumferential surface (29) of the turret (24), with the bag (10) being retained in the wrapping station (43) with the pocket (12) above the wrapping flap (16) and with the opening (17) oriented downward and, in a first folding or wrapping step, the pocket (12) are folded over in the downward direction until it butts against the central portion (19) of the wrapping flap (16).

17. The apparatus as claimed in claim 16, wherein the pocket (12), following release of the pocket holder (37) and, if necessary, stopping of the air supply to the suction bores (34), are folded over by a mechanism (56), with the folding lever (56) being mounted at a fixed location in the interior of the turret (24) and having at least one angled finger (58) for butting against the pocket (12).

18. The apparatus as claimed in claim 16, wherein a bottom region (20) of the wrapping flap (16) are folded in the upward direction by a fixed-location actuating mechanism until it butts against a free surface on the rear wall (15) of the bag (10) or of the pocket (12).

19. The apparatus as claimed in claim 18, wherein the peripheral flap (20) are folded, and fixed in the folding position, by a flap folder (59), which is mounted at a fixed location in the interior of the turret (24), by way of an angled, bracket-like leg (60).

20. The apparatus as claimed in claim 3, wherein the bag (10) is fixed at least in the region of the wrapping station (43) and/or in a discharging station by additional retaining mechanisms, namely retaining fingers (21, 22) which butt against the wrapping flap (16), or against the central portion (19) thereof, and belong to a retaining and transporting mechanism, with a carrier (61, 62) for the retaining fingers (21, 22) being fitted on an actuating mechanism (67), and therefore the retaining fingers (21, 22) grip the finished, wrapped bag (10) on two mutually opposite sides, remove the bag (10) from the turret (24) and deposit the bag (10) on the removal conveyor (44).

21. The apparatus as claimed in claim 20, wherein arranged in the region of the wrapping station (43) or of a discharging station is a transfer mechanism for transferring closure strips or tapes (23) to the wrapped bag (10), the transfer mechanism having a tape holder (66) for gripping a tape (23) and having a pivoting arm (65) for transferring the tape (23) to the bag (10).

22. The apparatus as claimed in claim 3, wherein the turret (24), which is mounted for rotation about a horizontal axis, is open in part on at least one side, and in that mechanisms for carrying out operations on the bags (10) and carrier mechanisms (57) for fixed-location, movable handling mechanisms project via the open side into the interior of the turret (24), with the processing mechanisms being positioned in the region of a processing station of the turret (24) and is guided through apertures (70) or openings (21) in the wall (25) of the turret (24) in order to execute handling operations on the outside of the turret (24).

23. The apparatus as claimed in claim 3, wherein the turret (24) has an end wall (26 or 79) which are subjected to loading and is for mounting or supporting the turret (24) on a drive-shaft (27), which is fitted at one end, or on a fixed axis-of-rotation element (72), which is guided through the turret (24) in the longitudinal direction and on which the turret (24) is supported by means of rotary bearings (73).

24. The apparatus as claimed in claim 3, wherein the turret (24) is driven in rotation by means of toothed gear mechanisms comprising a drive pinion (76), which meshes, on an open side of the turret (24), with a toothed ring (75) fitted peripherally within the turret.

25. The apparatus as claimed in claim 22, wherein fixed-location carriers for processing mechanisms (57) for folding, retaining or other mechanisms, are connected to, and/or mounted on, the fixed axis-of-rotation element (72) within the turret (24).

* * * * *